US007645154B2

(12) United States Patent
Baker et al.

(10) Patent No.: US 7,645,154 B2
(45) Date of Patent: Jan. 12, 2010

(54) USB CONNECTOR PROTECTIVE COVER

(75) Inventors: Todd Baker, Grass Lake, MI (US); Tanmoy Joshi, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 14 days.

(21) Appl. No.: 11/867,037

(22) Filed: Oct. 4, 2007

(65) Prior Publication Data

US 2009/0093152 A1 Apr. 9, 2009

(51) Int. Cl.
*H01R 13/52* (2006.01)

(52) U.S. Cl. ..... 439/271; 439/587

(58) Field of Classification Search ..... 439/135, 439/271, 521, 278, 587
See application file for complete search history.

(56) References Cited

U.S. PATENT DOCUMENTS 3,308,416 A * 3/1967 Boyd ..... 439/115
4,411,491 A * 10/1983 Larkin et al. ..... 385/73
6,736,545 B2 * 5/2004 Cairns et al. ..... 385/56
7,332,678 B2 * 2/2008 Pyron et al. ..... 174/660

* cited by examiner

*Primary Examiner*—Michael C Zarroli
(74) *Attorney, Agent, or Firm*—Shook, Hardy & Bacon L.L.P.

(57) ABSTRACT

A universal serial bus connector assembly for sealing a plug against the intrusion of foreign material is provided. The connector assembly includes a plug receptacle housing and a plug receptacle supporting structure attached to the plug receptacle housing. A bezel is fitted over the plug receptacle supporting structure. A sealing elastomeric membrane is positioned between the plug receptacle supporting structure and the bezel. A slit is formed in the elastomeric membrane through which the plug is inserted into the plug receptacle housing.

18 Claims, 2 Drawing Sheets

USB CONNECTOR PROTECTIVE COVER

TECHNICAL FIELD

The present invention relates generally to universal serial bus connectors. More particularly, the present invention relates to a universal serial bus connector which includes an elastomeric membrane for sealing against the intrusion of foreign material into the bus connector.

BACKGROUND OF THE INVENTION

The use of plug connectors has seen a variety of applications in vehicles. Some of these plug connectors are universal serial bus connectors. While providing a high degree of convenience and satisfaction to the user of the universal serial bus connector, the environment of the vehicle is typically unfriendly to the electronics of plugs given the relatively high amount of small-sized foreign material (most typically food) which is usually found in the vehicle interior. Thus the utility of such connectors in use in vehicles is compromised by the possible introduction of this foreign material into the plug receptacle. In addition, known universal serial bus connectors have poor aesthetic appeal.

In an effort to overcome these difficulties, a variety of protective covers have been introduced to provide a form of protection against the introduction of foreign materials. Such approaches provide hinged and sliding mechanical doors as well as removable covers and caps. While providing some degree of protection, known arrangements for attempting the provision of protection are overly complex and prone to failure. Many of the known arrangements have to be manipulated by the user for opening, closing, covering or uncovering before or after insertion of the plug into the connector. In those embodiments where caps or covers are used the caps and covers are prone to being lost by the user. In addition, once the plug is inserted into the receptacle of known systems, there is no continuing protection against intrusion of foreign material.

Accordingly, a need exists today for an improved system for restricting the introduction of foreign material into the plug receptacle.

SUMMARY OF THE INVENTION

A preferred embodiment of the disclosed invention is a universal serial bus connector assembly for sealing a plug against the intrusion of foreign material into the bus connector after plug is inserted therein. The universal serial bus connector assembly disclosed herein restricts the intrusion of foreign material into the bus connector both between uses and during use. The connector assembly includes a plug receptacle, a plug receptacle housing in which the plug receptacle is positioned, and a plug receptacle supporting structure attached to the plug receptacle housing. A sleeve extends from the plug receptacle supporting structure for operative association with the plug receptacle housing. A bezel is fitted over the plug receptacle supporting structure. A sealing elastomeric membrane is positioned between the plug receptacle supporting structure and the bezel. A slit is formed in the elastomeric membrane through which the plug is inserted into the plug receptacle housing.

The preferred embodiment of the disclosed invention is suitable for use in a variety of applications, including particularly use in automotive vehicles. Other applications are possible, including, for example, other vehicle applications as well as use in the home or in the workplace.

The disclosed invention also provides an aesthetic improvement to the universal serial bus connector assembly as used today. The elastomeric membrane also functions to conceal and protect the plug receptacle when the plug is not inserted without the need for the user to undertake any additional steps such as removing a cap or a cover or manipulating a slidable door or gate.

Other features of the invention will become apparent when viewed in light of the detailed description of the preferred embodiment when taken in conjunction with the attached drawings and the appended claims.

BRIEF DESCRIPTION OF THE DRAWINGS

For a more complete understanding of this invention, reference should now be made to the embodiment illustrated in greater detail in the accompanying drawings and described below by way of examples of the invention wherein.

DETAILED DESCRIPTION OF THE PREFERRED EMBODIMENT

Figure 1:
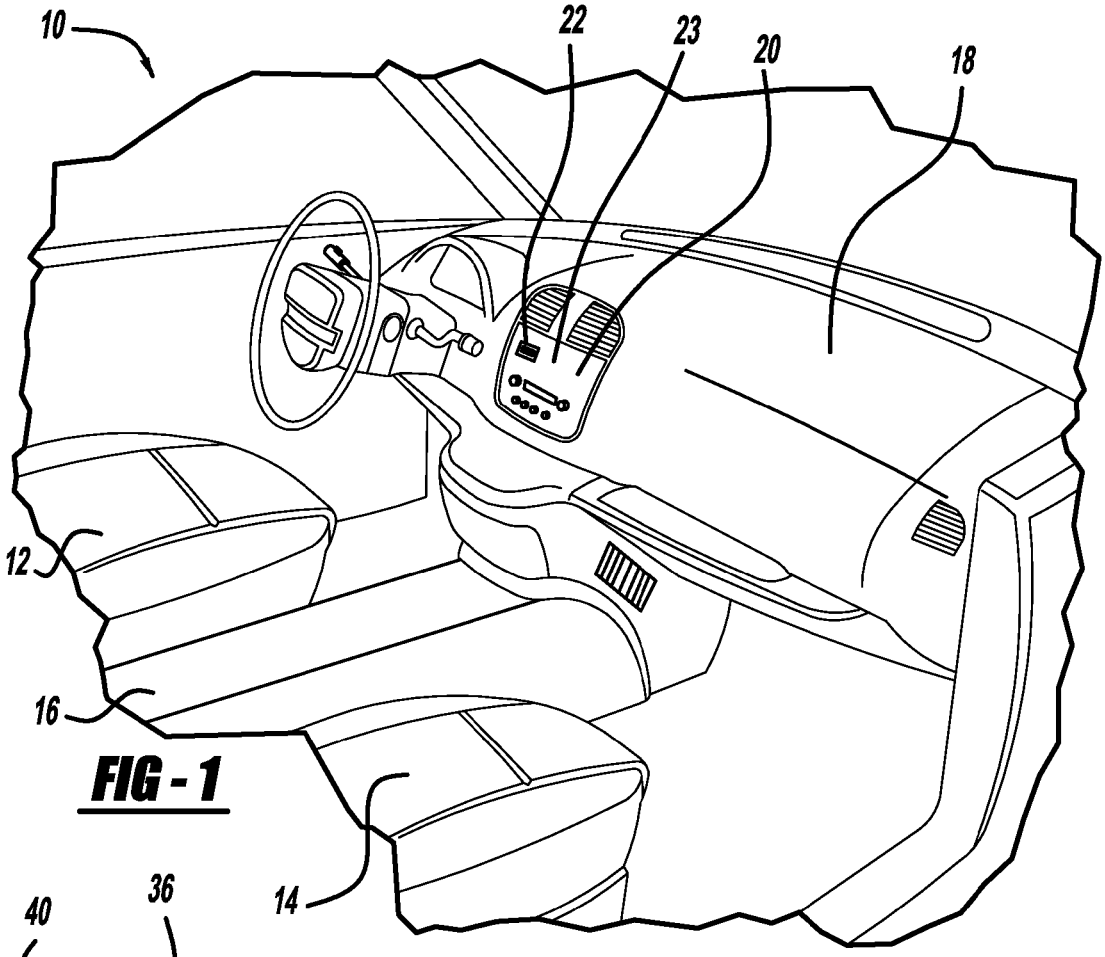
FIG. 1 illustrates an environmental view of a portion of an automobile interior showing general placement of the universal serial bus connector assembly having a protective cover of the disclosed invention.

In the following figures, the same reference numerals will be used to refer to the same components. In the following description, various operating parameters and components are described for one constructed embodiment. These specific parameters and components are included as examples and are not meant to be limiting.

Referring to the drawings and in particular to FIG. 1, a partial view of a vehicle interior, generally illustrated as 10, is shown. The vehicle interior includes a driver's seat 12, a passenger seat 14, a floor console 16, an instrument panel 18 on which an audio control cluster 20 is fitted, and a universal serial bus connector assembly 22 of the disclosed invention. The audio control cluster 20 includes a face plate 23 through which the connector assembly 22 is fitted.

The illustration of FIG. 1 notwithstanding, the connector assembly 22 may be fitted alternatively or additionally to other areas of the vehicle interior, such as on or near the center console storage area, in glove boxes, on a rear-seat passenger console or on surfaces adjacent to vehicle door handles. Given the ability of the connector assembly 22 to restrict the inward passage of foreign material, it can be fitted on a horizontal surface as well. Furthermore, the application of the disclosed invention is not to be limited to use within an automotive vehicle but can find application in other vehicles and may even find application in other circumstances as well, such as in home or office entertainment systems.

Figure 2:
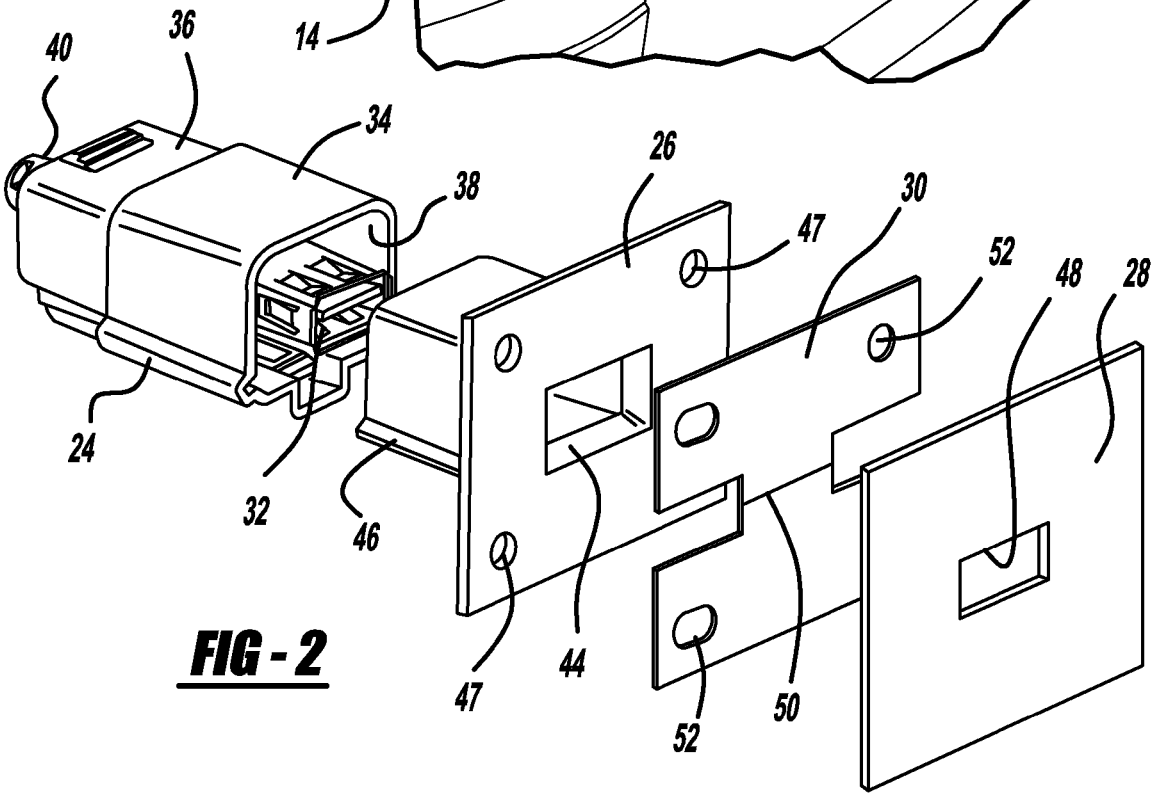
FIG. 2 illustrates an exploded view of the elements of the universal serial bus connector assembly having a protective cover of the disclosed invention.
Figure 3:
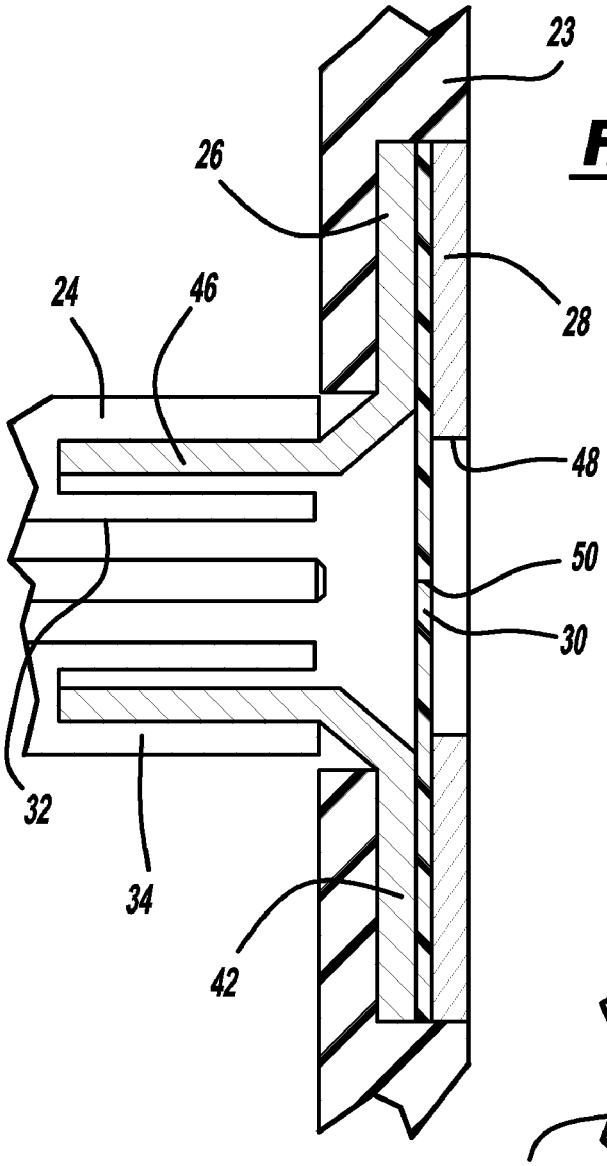
FIG. 3 is a sectional view showing the universal serial bus connector assembly having a protective cover positioned in an adjacent panel structure.

With reference to FIG. 2, an exploded view of the elements of the connector assembly 22 is illustrated. FIG. 3 illustrates a sectional view of the connector assembly 22 positioned in an adjacent panel structure. The illustrated components are suggestive and are not intended on being limiting to shape, size, configuration or structure.

With reference to both FIGS. 2 and 3, the connector assembly 22 includes a plug receptacle assembly 24, a receptacle support structure 26, a vehicle bezel 28 and an elastomeric membrane 30. Preferably these elements are provided as an assembly prior to installation into the vehicle audio control cluster or other adjacent structure.

The plug receptacle assembly 24 includes a plug receptacle 32 and a plug receptacle housing 34. The plug receptacle 32 may be of a variety of shapes and configurations, but as shown is suitable to provide a connection point for a rectangular universal serial bus plug or other plug of a rectangular, square, or round shape (not shown). The plug receptacle 32 extends from a plug receptacle assembly base 36. Also extending from the plug receptacle assembly base 36 is the plug receptacle housing 34. A gap 38 is generally formed between the plug receptacle 32 and the plug receptacle housing 34. A conduit 40 extends outwardly from plug receptacle assembly base 36. Of course, the conduit 40 could be formed as well at other locations on the plug receptacle assembly base 36. The conduit 40 may itself be a receptacle for receiving a plug connected to the vehicle's electrical system or may be a lead wire that is hard-wired to the vehicle's electrical system.

The receptacle support structure 26 includes a face plate 42 having a plug-passing aperture 44 defined therein. While a rectangular configuration is illustrated for the plug-passing aperture 44, it is to be understood that other configurations may be suitable as well to satisfy technical requirements.

Extending from one side of the receptacle support structure 26 is a sleeve 46 which fits substantially within the gap 38 formed between the plug receptacle 32 and the plug receptacle housing 34 of the plug receptacle assembly 24 when the receptacle support structure 26 is attached to the plug receptacle assembly 24 as illustrated in FIG. 3. The sleeve 46 provides for a solid connection between the plug receptacle assembly 24 and the receptacle support structure 26 and also provides an arrangement for resisting the lateral intrusion of foreign material.

The receptacle support structure 26 further includes a plurality of fastener apertures 47 which are used in attaching the receptacle support structure 26 to the face plate 23 of the audio control cluster 20. A plurality of conventional fasteners (not shown) is used for fastening the receptacle support structure 26 to the face plate 23. The receptacle support structure 26 may also be attached to the face plate 23 by heat staking, chemical adhesion (using various glues, including hot glue), or by snap-fitting.

The vehicle bezel 28 includes a plug-passing aperture 48 through which a plug (shown in FIG. 4) is passed when being used to provide an audio or video connection. While a rectangular configuration is illustrated for the plug-passing aperture 48, it is to be understood that other configurations may be suitable as well to satisfy technical requirements. The bezel 28 is fitted against the face plate 42 of the receptacle support structure 26 and to the elastomeric membrane 30 such that the elastomeric membrane 30 is effectively captured therebetween. The bezel 28 may be attached by an adhesive as is known in the art or by mechanical fastening, as is also known in the art.

The elastomeric membrane 30 includes a slit or notch 50 through which the plug is passed when the connector assembly 22 is in use. The elastomeric membrane 28 further includes a plurality of fastener apertures 52 which, like the fastener apertures 47 of the receptacle support structure 26, are used in attaching the elastomeric membrane 30 to the face plate 23 of the audio control cluster 20 as well as to the receptacle support structure 26. The same plurality of conventional fasteners (not shown) used for fastening the receptacle support structure 26 to the face plate 23 may be used for attaching the elastomeric membrane 30.

Figure 4:
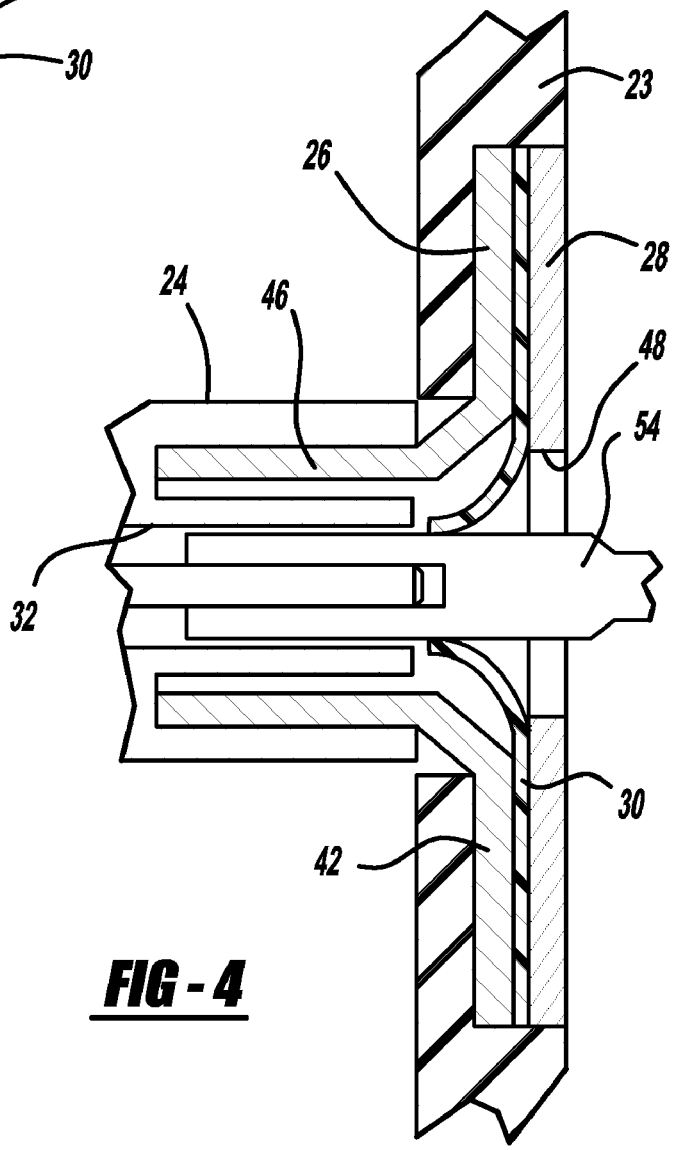
FIG. 4 is the same view as FIG. 3 but illustrating a plug inserted into the connector assembly.

The elastomeric membrane 30 may be composed of a variety of materials but is preferably composed of a polymerized material having a suitable degree of flexibility so as to be able to readily change shape between its closed or unused position as illustrated in FIGS. 2 and 3 to its open or used position as illustrated in FIG. 4, discussed below.

In addition to showing a sectional view of the assembled plug receptacle assembly 24, the receptacle support structure 26, the elastomeric membrane 30, and the vehicle bezel 28, FIG. 3 also illustrates the connector assembly 22 in place in the face plate 23 of, for example, the audio control cluster 20 shown in FIG. 1. As set forth above, the face plate 23 may be part of a variety of components, both vehicular and non-vehicular.

FIG. 3 illustrates the connector assembly 22 in place in the face plate 23 as it would appear in its unused condition, that is, without an audio or video plug inserted. As illustrated, in its closed or unused position the notch 50 of the elastomeric membrane 30 forms a tight seal which prevents the intrusion of foreign material. When a plug, such as a plug 54 illustrated in FIG. 4, is inserted into the connector assembly 22, again as illustrated in FIG. 4, the notch 50 of the elastomeric membrane 30 is opened to thereby allow the plug 54 to pass. Nevertheless, in spite of this opened condition, the notch 50 maintains a tight seal around the plug 54 to thereby prevent intrusion of foreign material into the connector assembly 22 during use. The tight seal defined by the notch 50 is illustrated in FIG. 4.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A conduit receptacle assembly for receiving and retaining an electrical plug comprising:

a plug receptacle assembly including a receptacle and a housing;

a receptacle supporting structure to which the plug is attached, said structure having a plug-receiving opening, said structure including a sleeve extending therefrom, said sleeve being placeable substantially between said receptacle and said housing;

an elastomeric membrane fitted over said opening of said structure, said membrane having a plug-passing opening.

2. The conduit receptacle assembly of claim 1 further including a bezel at least partially positioned over said elastomeric membrane whereby said elastomeric membrane is held between said receptacle supporting structure and said bezel.

3. The conduit receptacle assembly of claim 2 wherein said bezel has a plug-passing opening defined therein.

4. The conduit receptacle assembly of claim 1 wherein said plug-passing opening of said elastomeric membrane is a slit.

5. The conduit receptacle assembly of claim 1 wherein said plug receptacle assembly further includes a receptacle housing, said housing has having a wall, said wall being substantially spaced apart from said receptacle.

6. The conduit receptacle assembly of claim 5 wherein said receptacle supporting structure includes a front side, a back side and wherein said sleeve extends from said back side, said sleeve being placeable substantially between said wall of said housing and said receptacle.

7. The conduit receptacle assembly of claim 6 wherein said elastomeric membrane is fittable to said front side of said receptacle supporting structure.

8. The conduit receptacle assembly of claim 7 wherein said receptacle supporting structure further includes a plug-passing opening defined therein.

9. A conduit receptacle assembly for receiving and retaining an electrical plug comprising:

a plug receptacle assembly including a receptacle and a housing;

a plug securing and sealing portion including an elastomeric membrane through which the electrical plug is passed when the electrical plug is inserted into the assembly, said plug securing and sealing portion having a receptacle supporting structure having a sleeve extending therefrom, said sleeve being placeable substantially between said receptacle and said housing.

10. The conduit receptacle assembly of claim 9 wherein said plug securing and sealing portion includes a receptacle supporting structure to which the electrical plug is attached, said receptacle supporting structure having a plug-receiving opening, said elastomeric membrane being fitted over said plug-receiving opening of said receptacle supporting structure, said elastomeric membrane having a plug-passing opening formed therein.

11. The conduit receptacle assembly of claim 10 further including a bezel at least partially positioned over said elastomeric membrane whereby said elastomeric membrane is held between said receptacle supporting structure and said bezel.

12. The conduit receptacle assembly of claim 11 wherein said bezel has a plug-passing opening defined therein.

13. The conduit receptacle assembly of claim 10 wherein said plug-passing opening of said elastomeric membrane is a slit.

14. The conduit receptacle assembly of claim 9 wherein said housing is a plug receptacle housing and said plug receptacle assembly further includes a receptacle housing, said plug receptacle housing having a wall, said wall being substantially spaced apart from said receptacle.

15. The conduit receptacle assembly of claim 14 wherein said receptacle supporting structure includes a front side, a back side and wherein said sleeve extends from said back side, said sleeve being placeable substantially between said wall of said plug receptacle housing and said plug receptacle.

16. The conduit receptacle assembly of claim 15 wherein said elastomeric membrane is tillable to said front side of said receptacle supporting structure.

17. The conduit receptacle assembly of claim 16 wherein said receptacle supporting structure further includes a plug-passing opening defined therein.

18. A conduit receptacle assembly for receiving and retaining an electrical plug comprising:

a plug receptacle assembly including a receptacle, a housing and a supporting structure having a back side, said supporting structure having a sleeve extending from said back side for coupling with said housing, said sleeve being placeable substantially between said receptacle and said housing; and an elastomeric membrane positioned over said supporting structure, the electrical plug passing through said membrane when the electrical plug is inserted into the conduit receptacle assembly.

* * * * *